United States Patent [19]

Steiger et al.

[11] Patent Number: 4,868,098

[45] Date of Patent: Sep. 19, 1989

[54] METHOD OF PROCESSING EXPOSED PHOTOGRAPHIC SILVER DYE BLEACH MATERIALS COMPRISING HEATING AFTER PROCESSING LIQUID APPLICATION

[75] Inventors: Rolf Steiger, Praroman; Urs J. Fürholz, Marly, both of Switzerland

[73] Assignee: Ciba-Geigy AG, Basel, Switzerland

[21] Appl. No.: 171,917

[22] Filed: Jan. 5, 1988

[30] Foreign Application Priority Data

Jan. 6, 1987 [CH] Switzerland ..... 22/87
Apr. 28, 1987 [CH] Switzerland ..... 1615/87

[51] Int. Cl.[4] ..... G03C 5/38; G03C 7/42; G03C 7/32

[52] U.S. Cl. ..... 430/393; 430/351; 430/406; 430/419; 430/431; 430/434; 430/462; 430/463; 430/963

[58] Field of Search ..... 430/351, 378, 393, 406, 430/419, 431, 434, 436, 438, 441, 445, 460, 462, 463, 963

[56] References Cited

U.S. PATENT DOCUMENTS 3,620,725 11/1971 Kosta ..... 430/963
3,868,253 2/1975 Marthaler et al. ..... 430/963
3,963,492 6/1976 Marthaler et al. ..... 430/430
4,138,256 2/1979 Chylewski et al. ..... 430/392
4,197,123 4/1980 Oetiker et al. ..... 430/391

OTHER PUBLICATIONS

Levenson et al., Journal of Scientific Instruments, vol. 27, pp. 170–171 (1950).
Holden et al., Journal of Scientific Instruments, vol. 28, pp. 318–319 (1951).
Jacobs, Photographic Science and Engineering, vol. 1, pp. 63–67 (1958).

*Primary Examiner*—Paul R. Michl
*Assistant Examiner*—Patrick A. Doody
*Attorney, Agent, or Firm*—Wenderoth, Lind & Ponack

[57] ABSTRACT

The processing of exposed silver dye bleach materials by applying, to the uppermost layer of the material, an amount of processing liquid which corresponds to not more than the swelling volume of the material, followed by a heat treatment.

The process is particularly suitable for the production of positive colored images, especially in automatic copying or photographing machines.

16 Claims, 1 Drawing Sheet

Figure 1:
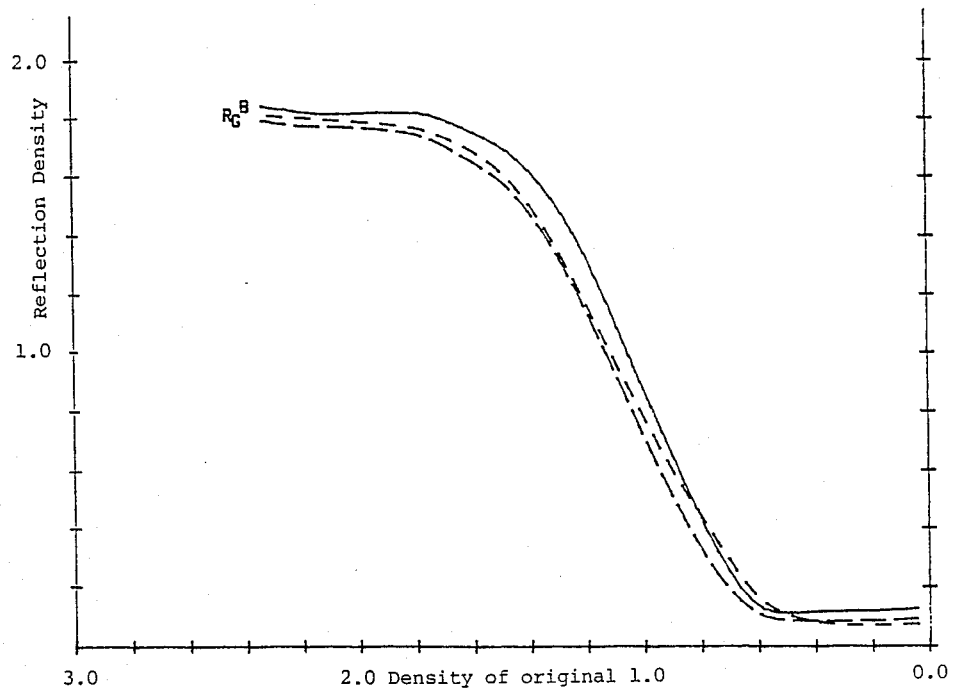

METHOD OF PROCESSING EXPOSED PHOTOGRAPHIC SILVER DYE BLEACH MATERIALS COMPRISING HEATING AFTER PROCESSING LIQUID APPLICATION

The present invention relates to a method of processing exposed photographic silver dye bleach materials.

Methods of processing exposed silver dye bleach materials have been disclosed in a number of patent specifications, for example German Patent Nos. 2,448,433 and 2,651,969 and EP No. 14,688. In accordance with these methods the materials to be processed are immersed in the processing solutions until the appropriate processing stage is complete. However, the methods have the disadvantage that a large amount of processing liquid is required for their performance. This disadvantage does not only manifest itself in the complicated handling of the large-volume processing baths. When consideration is given, for example, to the requirements set nowadays for the processing times of the materials, the temperatures of the baths have had to be increased again and again in order to meet the requirement for increasingly shorter processing times. This obviously results in a continually increasing energy requirement, which is the higher the greater the amount of processing liquid to be used. Thus the processing costs increase, while at the same time the stability of the baths suffers from the increase in temperature. It has not been possible to increase the utilization capacity of these baths beyond about 5 $m^2$ per liter, although efforts have been made to improve this figure. Finally, problems relating to the disposal of large amounts of exhausted processing liquids also arise and are associated with considerable effort and expense.

A process in which the photographic material was passed through a developer liquid in the course of about 5 seconds and then, loaded with a small developer liquid, was exposed and virtually simultaneously heated by means of a heated roller and thereby developed, has already been suggested, for the rapid processing of oscillograph paper, by G.I.P Levenson in the Journal of Scientific Instruments, 27, (1950), pages 170 to 171 and by A. V. Holden et al. in the Journal of Scientific Instruments, 28, 1951, pages 318 to 319. However, this process could only be used for oscillograph papers, since it gave a flat contrast, considerable haze and a substantially lower maximum density than normal developing. This process was completely unsuitable for imagewise applications.

It is therefore the object of the present invention to indicate a method of processing exposed silver dye bleach materials which can be carried out with markedly smaller amounts of processing liquid than have hitherto been customary and which affords photographic images of high quality.

The object is achieved, according to the invention, by applying an amount of processing solution, corresponding to not more than the swelling volume, in the form of a thin film of liquid to the uppermost layer of the exposed material, and then heat-treating the material.

This is because it has been found, surprisingly, that even the swelling volume of processing liquid is adequate, not only for development and fixing, but also for dye bleaching and silver bleaching. In addition the process according to the invention has the advantage that the material remains almost dry during processing.

The present invention therefore relates to a method of processing exposed photographic silver dye bleach materials using the process stages (1) development, (2) dye bleach, (3) silver bleach, (4) fixing and (5) washing, it being possible to combine process stage (3) with process stage (2), or with process stages (2) and (4) into one process stage, which comprises, for the process stages (1) and (2) or the process stages (1) and also (2) and (3) combined or the process stages (1) and also (2) and (3) and (4) combined, applying to the uppermost layer of the material an amount of corresponding processing liquid which is equivalent to not more than the swelling volume of the material, subjecting the material to a heat treatment after each treatment with processing liquid, and, if appropriate, washing and drying the material. In the following text, the swelling volume of the material is to be understood as meaning the volume of liquid which this material absorbs when it is immersed for at least 1 second in water.

The swelling volume depends on the layer thickness of the material concerned, the degree of curing of the binder in the layers and other additives to the layers such as are described, for example, in Research Disclosure 17,643, 1978, sections IX B and XII A, and especially on the added amount of the strongly swellable polymers according to German Patent No. 3,546,164. In general, it is 2 to 5 times as great as the volume of the stack of layers in the dry state. The magnitude of the swelling volume can be regulated by means of intermediate layers in the material, for example between the film base and the first light-sensitive layer, without impairing the photographic properties of the material.

The determination of the swelling volume of a material can be effected in a simple manner, for example by weighing the material before and after immersion in water.

In accordance with the invention, the swelling volume is the maximum amount of processing liquid applied to the material. The minimum amount of processing liquid corresponds to the fraction of the swelling volume with which it is still just possible to carry out the intended processing stage. This minimum amount, which obviously depends also on the structure of the material to be processed, can be determined easily by means of routine tests.

The processing liquid is applied in the form of a thin film only to the emulsion side of the material to be processed. This can be effected by known methods, for example by spraying or applying the liquid by means of rollers or thin slits past which the material is conveyed. These methods and other coating processes are described in detail, for example in Photographic Science and Engineering, volume 1, 1958, pages 156 to 160, and volume 5, 1961, pages 48 to 54. It is also possible to use, for the application of the processing solutions, coating processes for the production of photographic components, such as are described, for example, in Research Disclosure 17,643, 1978, section XV A. Spraying the solutions by means of jets used in the ink-jet printing process has proved particularly advantageous.

In order to achieve homogeneous distribution of the small amount of liquid on the surface of the emulsion, it is generally necessary to add wetting agents to the processing liquids. Wetting agents suitable for this purpose are anionic or nonionic wetting agents such as are mentioned, for example, in Research Disclosure 17,643, 1978, section XI A. Fatty acid alkanolamides, alkylaryl polyether-sulfates, polyethoxy compounds and perfluoro compounds such as are enumerated, for example, in German Patent No. 1,942,665, are particularly suitable.

After the processing liquid has been applied, the material is subjected to a heat treatment until the appropriate processing stage is complete. The procedure used for this can be for example the methods indicated in the Journal of Scientific Instruments, volume 27, 1950, pages 170 to 171 and in The Engineer, 1955, pages 373 to 375 and 441 to 442, in which the material charged with the processing liquid is brought into contact with a heated plate. It is also possible, however, to heat the material by irradiation with microwaves or infrared light.

For process stage (1) it is generally sufficient to use temperatures from 30° to 70° C., preferably 30° to 60° C. For the other process stages, in particular process stage (2), the temperatures required are between 30 and 120, in particular 50 and 120 and preferably between 60° and 90° C.

The treatment time is generally between 1 and 40 seconds.

The developer liquid to be used in process stage (1) can have the compositions customary for black-and-white developers, such as benzene compounds substituted by hydroxyl groups and/or (substituted) amino groups, and (substituted) 1-phenylpyrazolidinones as developer substances, and also antioxidants, such as sodium sulfite, anti-fogging agents and clarifiers, such as potassium bromide, benzotriazole and mercaptobenzothiazole, silver complex-forming agents, organic solvents and wetting agents and the like. Compositions of this type are described, for example, by G. Haist in Modern Photographic Processing, volume 1. John Wiley and Sons, N.Y., 1979 and L. F. Mason in Photographic Processing Chemistry, Focal Press, London, 1966, and are also disclosed, for example, in EP No. 14,688, German Patent Nos. 2,831,814 and 2,640,659, EP Nos. 56,787, 44,813, 44,812, 23,888 and German Patent No. 1,180,788. In the process according to the invention it is preferable to use a hydroquinone-phenidone developer of the customary composition, the concentration of hydroquinone being between 15 and 35 g/l. The pH of the developer liquid is preferably between 9.3 and 11.5. In addition, the developer can contain 0.05 to 1% of a nonionic wetting agent, for example Emcol 5130 (Witco Chemical Corporation).

In a particularly advantageous embodiment the concentrations of phenidon and benzotriazole in the developer are matched in such a way that almost no development takes place at room temperature, i.e. not more than 10% of the amount of silver is developed in the course of 30 seconds. This makes it possible to prevent inhomogeneous development caused by non-uniform application of the developer liquid. Development of the exposed material is carried out only after thermal activation, by treating the material with developer liquid for 1 to 20 seconds at, preferably, 30° to 70° C.

Particularly suitable concentrations of phenidone and benzotriazole are within the range from 0.1 to 0.6 and from 0.9 to 1.6, respectively, g/l. The ratio (by weight) of phenidone to benzotriazole here is preferably 1 to 4.

Immediately afterwards or after cooling, the bleach liquid corresponding to process stage (2), or (2) combined with (3), or (2) combined with (3) and (4), is applied to the developed material. These process stages and the compositions of the corresponding processing liquids are disclosed in a large number of patent specifications, for example in German Patent Nos. 2,037,684, 1,924,723, 2,258,076, 2,423,814, 2,448,433, 2,651,969, 2,722,777, 2,722,776 and 2,737,142, EP Nos. 34,793, 14,688, U.S. Pat. Nos. 3,615,493 and 3,544,326, German Patent No. 2,600,966 and U.S. Pat. No. 4,070,188.

The components available for the process stages mentioned embrace strong inorganic and organic acids, such as sulfuric acid, sulfamic acid, hydrobromic acid and hydriodic acid, complex-formers, such as iodides, bromides, mercapto compounds, thiocyanates, thiourea, thiosulfates and sulfites, oxidizing agents, such as quinones, azo compounds, heavy metal salts, nitroso and nitro compounds, dye bleach catalysts, for example diazines, anti-oxidants, such as reductones and ascorbic acid, and bleaching accelerators, for example quaternary ammonium salts and phosphines. Other customary additives which can be added are, for example, solvents, such as propyl alcohol and ethylene glycol monomethyl ether, wetting agents, hardeners, UV absorbers and optical brighteners.

For process stage (2) according to the invention it is preferable to use a processing liquid having a composition similar to the treatment bath described in German Patent No. 2,448,433 for the combined dye bleach and silver bleach of silver dye bleach materials, the processing liquid preferably containing, per kg, 5 to 30 g of a water-soluble aromatic nitro compound, 15 to 40 g of an iodide (as potassium iodide), 50 to 200 g of sulfuric acid or another suitable (in)organic acid, 2 to 15 g of dye bleach catalyst and 0.5 to 20 g of a nonionic wetting agent.

The material coated with a dye bleach liquid is then heated for 1 to 40 seconds, preferably at 50° to 120° C., to bleach the dyes.

Processing liquids having the same composition as the processing liquids for process stage (2) are used for process stage (2) and (3), according to the invention, combined. However, it is necessary to increase the content of potassium iodide to 40 to 250 g per kg of processing liquid.

Processing liquids for processing stage (2), (3) and (4), according to the invention, combined are described in German Patent No. 2,651,969. In addition to a strong acid, a water-soluble organic oxidizing agent and a dye bleach catalyst, they contain a water-soluble phosphine, preferably in an amount of 5 to 150 g per kg of processing liquid. In addition, other ligands, such as thiocyanate, bromide, iodide and/or thiourea can also be present.

It is also possible to use, for the combined process stages (2) and (3) or (2), (3) and (4), processing liquids which are free from iodide ions and instead contain bromide ions as complex-formers. If hydrobromic acid is used, for example, processing liquids of a simple composition are formed, since hydrobromic acid affords protons and complex-formers at the same time. Processing liquids of this type then contain only hydrobromic acid, dye bleach catalyst and nitro compound. These components are preferably present in concentrations of 100 to 350 g/kg of 48% hydrobromic acid, 1 to 5 g/kg of dye bleach catalyst and 2 to 30 g/kg of nitro compound.

The material treated in this way is finally washed in a customary manner and then dried.

The process according to the invention makes it possible to process silver dye bleach materials in which the base is capable of absorbing virtually no processing liquids. For example, materials having bases composed of polyester and pigmented or unpigmented cellulose acetate are thus suitable. Film bases composed of paper should be provided with a layer of a coating or polymer on both sides. Information on the many possible ways of arranging different photographic layers on the bases mentioned is available from a large number of patent specifications. The following may be mentioned, for example: German Patent Nos. 1,938,823, 1,938,768, 2,121,175, 2,121,176, 2,132,836, 2,132,835, 2,147,560, 2,216,592, 2,216,620, 2,223,311, 2,547,720 and 2,831,814 and EP No. 39,313.

The process according to the invention will be illustrated by means of the following examples.

EXAMPLE 1

A photographic material for the silver bleach process is prepared. This is effected by applying the following layers to a polyethylene-coated paper base: a gelatin substratum of 1.2 g $\times m^{-2}$ of gelatin, a red-sensitive layer containing, per $m^2$, 1.0 g of gelatin, 0.47 g of silver in the form of silver bromoiodide emulsion containing 2.6 mol % of iodide and 155 mg of the cyan image dye of the formula (100)

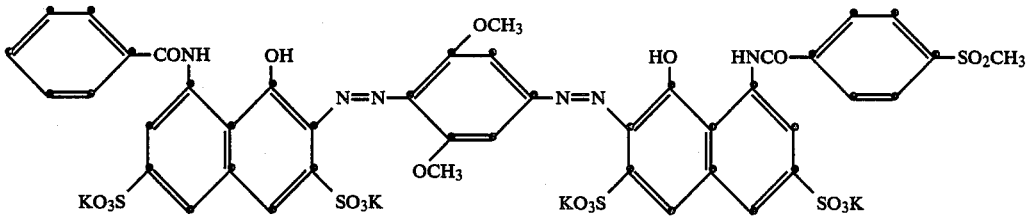

a gelatin intermediate layer of 1.5 g$\times m^{-2}$ of gelatin, a green-sensitive layer containing, per $m^2$, 1.4 g of gelatin, 0.24 g of silver in the form of silver bromoiodide emulsion containing 2.6 mol % of iodide and 165 mg of the magenta image dye of the formula (101)

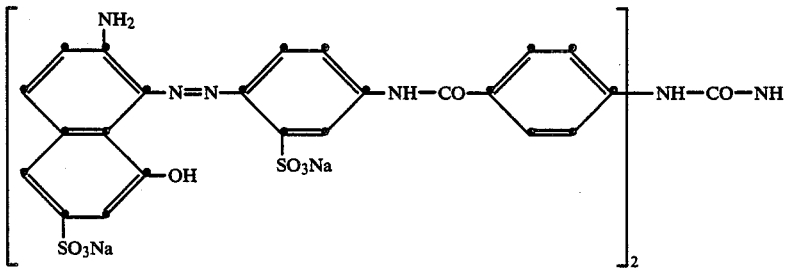

a filter yellow layer of 1.6 g$\times m^{-2}$ of gelatin, 0.04 g $\times m^{-2}$ of colloidal silver and 0.054 g$\times m^{-2}$ of the yellow dye of the formula (102)

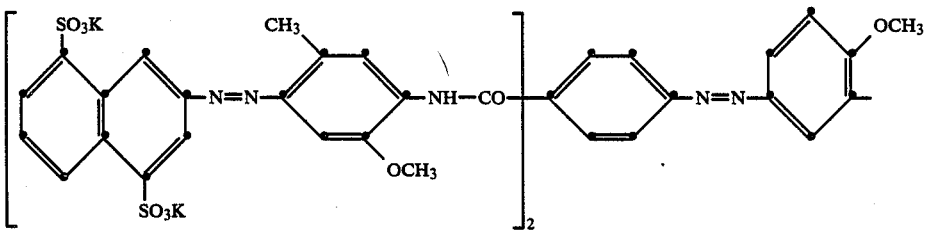

a blue-sensitive layer containing, per $m^2$, 0.9 g of gelatin, 0.22 g of silver in the form of silver bromoiodide emulsion containing 2.6 mol % of iodide and 80 mg of the yellow dye of the formula (102), and a gelatin protective layer of 0.8 g$\times m^{-2}$ of gelatin. The material also contains 0.23 g of the gelatin hardener 2,4-dichloro-6-hydroxytriazine (potassium salt). If this material is immersed in water for 1 second, the increase in weight is 96 g/$m^2$.

The material is exposed at an illumination of 50 lux for 1.5 seconds behind a step wedge. 24 ml of developer per $m^2$ of base area are then applied uniformly to the emulsion side of the material at room temperature by means of a "K" control coater (R.K. Print-Coat Instruments, Lillington, Royston, UK), and the material is warmed for 10 seconds on a hotplate at 35° C.

The developer has the following composition:

| | |
|---|---|
| Sodium diethylenetriaminepentaacetate (40%) | 20.6 g |
| Potassium hydroxide | 31.0 g |
| Potassium metabilsulfite | 25.5 g |
| Sodium sulfite | 14.7 g |
| Boric acid | 15.7 g |
| Potassium bromide | 2.0 g |
| Ascorbic acid | 9.8 g |
| Diethylene glycol monoethyl ether | 49.0 g |
| Hydroquinone | 29.4 g |
| Phenidone Z | 2.9 g |
| Benzotriazole | 0.9 g |
| Emcol 5130 (3%) | 15.3 g |
| Water to make up to | 1,000 g |

24 ml of dye bleach bath (temperature 20° C.) per $m^2$ of base area are then applied uniformly as indicated above to the emulsion side of the material, and the latter is heated for 5 seconds on a hotplate at a temperature of 90° C. The bleach liquor has the following composition:

| | |
|---|---|
| Sodium m-nitrobenzenesulfonate | 19.3 g |
| Sulfuric acid (concentrated) | 165.4 g |
| Potassium iodide | 29.6 g |
| Adduct of 35 mol of ethylene oxide with 1 mol of octadecyl alcohol | 11.5 g |
| 2,3,6-Trimethylquinoxaline | 8.9 g |
| Sodium 3-mercaptopropanesulfonate | 17.1 g |
| Acetic acid (100%) | 41.9 g |
| Water to make up to | 1,000 g |

The silver development and dye bleach are thus concluded. The material still contains excess silver and silver halide, which can be removed in a conventional manner by means of known silver bleach baths and fixing baths, for example by the action, for one minute, of a silver bleach bath containing, per liter of solution:
18 g of $CuSO_4.5H_2O$
20 g of KBr
150 ml of HCl (concentrated)
and subsequent fixing in a fixing bath containing, per liter of solution:
200 g of ammonium thiosulfate,
24 g of ammonium bisulfite and
39 g of ammonium sulfite.

The material is then washed for 2 minutes and is dried.

A positive image of the grey wedge used for exposure is obtained with very good contrast equilibrium of the three colour channels and good minimum density. The integral reflectance densities measured are plotted in FIG. 1 as a function of the logarithm of the exposure for the three colour channels red, green and blue.

EXAMPLE 2

The material described in Example 1 is exposed and developed as indicated therein. After development, 24 ml of a combined silver dye bleach bath (temperature 20° C.) per $m^2$ are applied uniformly, in the manner indicated in Example 1, to the emulsion side of the material, and the latter is brought into contact for 5 seconds with a hotplate at a temperature of 90° C. The silver dye bleach liquor has the following composition:

| | |
|---|---|
| Sodium m-nitrobenzenesulfonate | 19.3 g |
| Sulfuric acid (concentrated) | 165.4 g |
| Potassium iodide | 101.0 g |
| Adduct of 35 mol of ethylene oxide with 1 mol of octodecyl alcohol | 11.5 g |
| 2,3,6-Trimethylquinoxaline | 8.9 g |
| Sodium 3-mercaptopropanesulfonate | 17.1 g |
| Acetic acid (100%) | 41.9 g |
| Water to make up to | 1,000 g |

After the silver dye bleach, the material is fixed, washed and dried in a conventional manner. A positive image of the grey wedge used for the exposure is obtained, having properties similar to those described in Example 1.

EXAMPLE 3

The material described in Example 1 is first treated as in Example 2. After the silver dye bleach, 63 ml of fixing solution of the following composition:

| | |
|---|---|
| Ammonium thiosulfate | 200 g |
| Ammonium bisulfite | 12 g |
| Ammonium sulfite | 39 g |
| Water to make up | 1,000 g |

are applied per $m^2$ of material. This is allowed to act for 30 seconds at room temperature. A further 31 ml of this fixing solution per $m^2$ of material are then applied. After a further 30 seconds treatment time at room temperature the material is washed and dried in a customary manner. A result similar to that described in Example 1 is obtained.

EXAMPLE 4

The material described in Example 1 is exposed and developed as indicated therein. After development, 24 ml of a combined silver dye bleach and fixing bath (temperature 20° C.) per $m^2$ are applied uniformly to the emulsion side of the material in the manner indicated in Example 1, and the material is heated for 10 seconds at 120° C. on a hotplate. The combined silver dye bleach and fixing bath has the following composition:

| | |
|---|---|
| Sodium m-nitrobenzenesulfonate | 19.3 g |
| Sulfuric acid (concentrated) | 165.4 g |
| Adduct of 35 mol of ethylene oxide with 1 mol of octadecyl alcohol | 11.5 g |
| 2,3,6-Trimethylquinoxaline | 8.9 g |
| Bis-(2-cyanoethyl)-(3-sulfopropyl)-phosphine | 250.0 g |
| Acetic acid (100%) | 41.9 g |
| Water to make up to | 1,000 g |

After the combined silver dye bleach and fixing, the material is washed and dried in a conventional manner. A positive image of the grey wedge used for the exposure is obtained, having properties similar to those described in Example 1.

EXAMPLE 5

In this example the development of the exposed material according to Example 1 is carried out only after thermal activation.

| Developer composition: | |
|---|---|
| Phenidone Z | 0.3 g per liter |
| Benzotriazole | 1.2 g per liter |

All the other components of the developer are present in the same concentration as in the developer of Example 1.

Development is carried out for 5 seconds on a hotplate at 60° C. After dye bleaching, silver bleaching, fixing, washing and drying as in Example 1, a positive image of the grey wedge used for the exposure is obtained, having properties similar to those described in Example 1.

Whereas when the developers of Examples 1 to 4 were used after exposure to white light and development at 20° C., as much as 70% of the total amount of silver coated was developed after a swelling time of 30 seconds, this amount of silver was only 10% under the same conditions using the developer described here.

EXAMPLE 6

The photographic silver dye bleach material described in Example 1 is exposed behind a step wedge, developed for 1 minute at 39° C. in a conventional black-and-white developer, washed for 2 minutes and dried. The developer has the following composition:

| | |
|---|---|
| Sodium ethylenediaminetetraacetate | 2 g |
| Potassium sulfite | 37 g |
| Sodium sulfite | 15 g |
| Phenidone Z | 3 g |
| Hydroquinone | 15 g |
| Potassium metaborate | 11 g |
| Boric acid | 7.7 g |
| Ascorbic acid | 12.3 g |
| Potassium bromide | 2 g |
| Benzotriazole | 0.9 g |
| Water to make up to | 1,000 ml |

24 ml per $m^2$ of a bleach bath (temperature 20° C.) of the following composition are applied, as in Example 1, to the emulsion side of the material treated in this way:

| | |
|---|---|
| Hydrobromic acid (48%) | 337 g |
| 2,3,6-Trimethylquinoxaline | 1.5 g |
| Sodium m-nitrobenzenesulfonate | 2.0 g |
| Adduct of 35 mol of ethylene oxide with 1 mol of octadecyl alcohol | 2.0 g |
| Water to make up to | 1,000 ml |

The material is then heated on a hotplate for 5 seconds at 70° C. and is fixed and then washed in a conventional manner.

A positive image of the grey wedge used for the exposure is obtained, with a good contrast equilibrium and very good minimum density.

What is claimed is:

1. A method of processing exposed photographic silver dye bleach materials using the process stages (1) development, (2) dye bleach, (3) silver bleach, (4) fixing and (5) washing, it being possible to combine process stage (3) with process stage (2), or with process stages (2) and (4) into one process stage, which comprises, for the process stages (1) and (2) or the process stages (1) and also (2) and (3) combined or the process stages (1) and also (2) and (3) and (4) combined, applying to the uppermost layer of the material an amount of corresponding processing liquid which is equivalent to not more than the swelling volume of the material, subjecting the material to a heat treatment after each treatment with processing liquid, and, if appropriate, washing and drying the material.

2. A process according to claim 1, wherein a processing liquid containing hydroquinone and phenidone is used for process stage (1), hydroquinone being present in a concentration of 15 to 35 g/l.

3. A process according to claim 1, wherein a processing liquid containing phenidone and benzotriazole in an amount such that virtually no development takes place at room temperature is used for process stage (1).

4. A process according to claim 3, wherein the concentrations of phenidone and benzotriazole are within the range from 0.1 to 0.6 and 0.9 to 1.6, respectively, g/l.

5. A process according to claim 1, wherein a processing liquid containing, per kg, 5 to 30 g of a water-soluble organic nitro compound, 15 to 40 g of iodide, 50 to 200 g of sulfuric acid, 2 to 15 g of dye bleach catalyst and 0.5 to 20 g of nonionic wetting agent is used for process stage (2).

6. A process according to claim 1, wherein a processing liquid containing, per kg, 5 to 30 g of a water-soluble organic nitro compound, 40 g to 250 g of iodide, 50 to 200 g of sulfuric acid, 2 to 15 g of dye bleach catalyst and 0.5 to 20 g of nonionic wetting agent is used for the process stages (2) and (3) combined.

7. A process according to claim 1, wherein a processing liquid containing, per kg, 2 to 30 g of a water-soluble organic nitro compound, 100 to 350 g of hydrobromic acid, 1 to 5 g of dye bleach catalyst and 0.5 to 20 g of nonionic wetting agent is used for the process stages (2) and (3) combined.

8. A process according to claim 1, wherein a processing liquid containing a strong acid, a water-soluble organic oxidizing agent, a dye bleach catalyst, a water-soluble phosphine and, if appropriate, thiocyanate, bromide, iodide and/or thiourea is used for the process stages (2) and (3) and (4) combined.

9. A process according to claim 1, wherein the material is heated at 30° to 70° C. in the heat treatment for process stage (1).

10. A process according to claim 1, wherein the material is heated at 30° to 60° C. in the heat treatment for process stage (1).

11. A process according to claim 1, wherein the material is heated at 30° to 120° C. in the heat treatment for the process stages (2), (2) and (3) combined, (2) and (3) and (4) combined, and (4).

12. A process according to claim 11, wherein the material is heated at 50° to 120° C.

13. A process according to claim 12, wherein the material is heated at 60° to 90° C.

14. A process according to claim 1, wherein the heat treatment is effected by means of a hotplate or IR or microwave irradiation.

15. A process according to claim 1, wherein the appropriate processing liquid is sprayed onto the uppermost layer of the material by means of jets such as are used in ink-jet printing processes.

16. A process according to claim 1, wherein the silver dye bleach material is a copying material.

* * * * *